US006216944B1

(12) United States Patent
Maglione

(10) Patent No.: US 6,216,944 B1
(45) Date of Patent: Apr. 17, 2001

(54) COLLAPSIBLE GRAVITY FEED DISPLAY

(76) Inventor: Stephen Thomas Maglione, 71 Baltusrol Way, Far Hills, NJ (US) 07931

( * ) Notice: Subject to any disclaimer, the term of this patent is extended or adjusted under 35 U.S.C. 154(b) by 0 days.

(21) Appl. No.: 09/449,784

(22) Filed: Nov. 26, 1999

Related U.S. Application Data

(60) Provisional application No. 60/154,710, filed on Sep. 18, 1999.

(51) Int. Cl.[7] ..... B65D 5/72
(52) U.S. Cl. ..... 229/122.1; 229/194
(58) Field of Search ..... 229/104, 122.1, 229/194; 221/305

(56) References Cited

U.S. PATENT DOCUMENTS 2,886,232 * 5/1959 Leone ..... 229/122.1
3,204,762 * 9/1965 Shanok et al. ..... 229/122.1
3,373,867 * 3/1968 Wood ..... 229/194
4,318,505 * 3/1982 Cordell, Jr. ..... 229/194
4,739,922 * 4/1988 Zimmermann ..... 229/122.1
4,955,529 * 9/1990 Barnhart ..... 221/305
5,328,082 * 7/1994 Fritz et al. ..... 221/305
5,458,272 * 10/1995 Ward-Weber ..... 229/122.1
5,690,230 * 11/1997 Griffith ..... 229/122.1
5,813,597 * 9/1998 Wakevainen ..... 229/122.1

* cited by examiner

*Primary Examiner*—Gary E. Elkins

(57) ABSTRACT

A single one piece blank is folded over to form a gravity feed tube for point of sale display of products such as disposable cameras packaged in boxes with display cards. The rear wall has two overlying panels, the outer one of which has openings in a linear array and the other inner panel has locking tabs aligned with the openings. The tabs are pulled through the outer panel openings. The tabs have wings which engage the outer panel to lock the outer panel to the inner panel locking the blank in the tube configuration. A set of flaps in the bottom region form a feed opening and shelf for the product to be dispensed. A locking tab locks the bottom flaps closed. The side walls, front and rear walls have overlapping interior panel flaps at the top of the tube channel to provide a finished appearence to the interior at the open top.

13 Claims, 8 Drawing Sheets

COLLAPSIBLE GRAVITY FEED DISPLAY

This application claim the benefit of prior provisional application Serial No. 60/154,710 filed Sep. 18, 1999.

This invention relates to dislays for displaying articles and more particularly, to paperboard gravity feed displays for displaying articles at point of sale locations.

Gravity feed paperboard displays are known. Such displays comp paperboard sheets formed into elongated channels for feeding square or rectangular products such as film packs and disposable cameras for example. The product is placed into the channel from the top of the tube. At the base is an opening and a shelf on which the product rests due to gravity force on the product in the channel, which is vertical. The product is removed manually from the opening, one at a time. Such feed tubes are relatively simple and comprise one piece construction in which a flap along the tube length is folded over and glued to a mating wall of the tube.

A need is seen for an improved feed tube construction wherein the glue is not essential and no additional components are required, to thereby reduce cost of the display.

A one piece paperboard display for feeding articles to be dispensed by gravity according to the present invention comprises a paperboard tube having a rectangular chamber for storing and feeding articles. The tube has an elongated front wall, first and second opposing side walls, the first side wall being hinged to the front wall at a first foldline and the second side wall being hinged to the front wall at a second foldline distal the first foldline, and a rear wall formed by a first panel hinged to the first side wall and a second panel hinged to the second side wall, the first and second panels being juxtaposed with the first panel being exterior and second panel being interior. A shelf is secured to one of the wall adjacent to the bottom end of the walls and form a bottom wall of the chamber for supporting articles in the chamber when vertical. Locking tab means are coupled to the first and second panels to releasably secure the juxtaposed panels together to form a collapsible tube. Thus no glue or other parts are necessary to secure the walls and panels together forming a simple collapsible feed tube.

In one aspect the locking tab means comprises a tab on the inner panel and a tab locking opening in the outer panel for receiving and releasably securing the tab to the outer panel.

According to the length of the tube, a plurality of the tabs and locking openings may be included.

IN THE DRAWING

Figure 1:
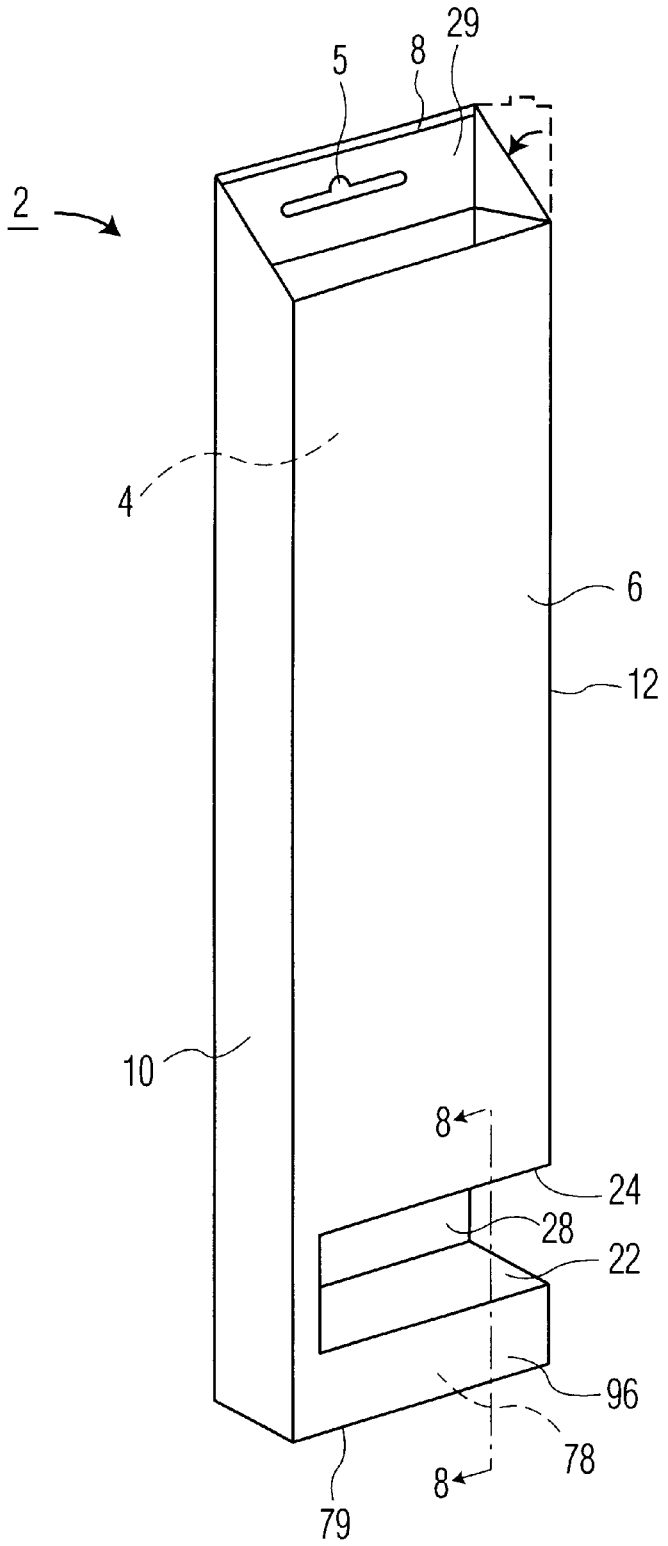
FIG. 1 is an isometric view of a gravity feed display according to an embodiment of the present invention.
Figure 2:
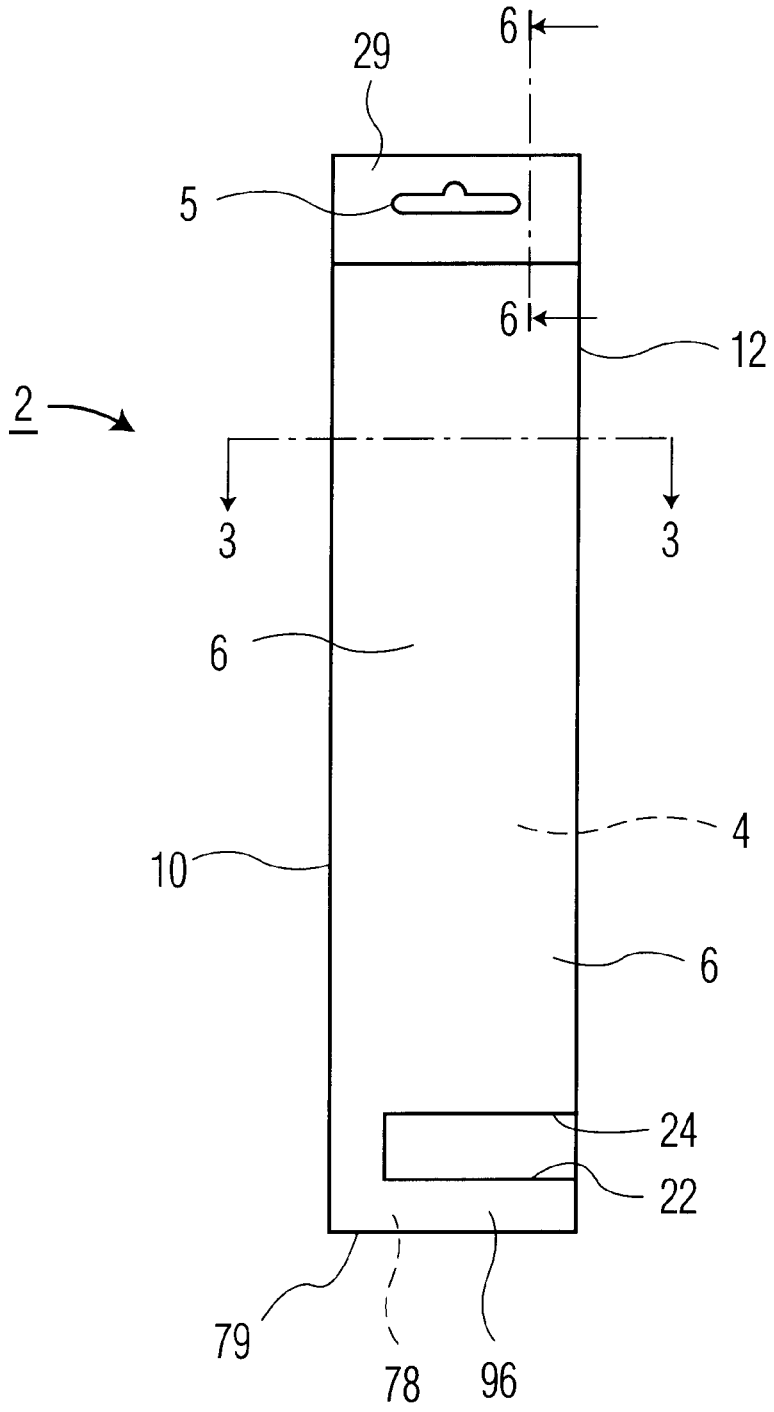
FIG. 2 is a front elevation view of the display of FIG. 1.
Figure 2A:
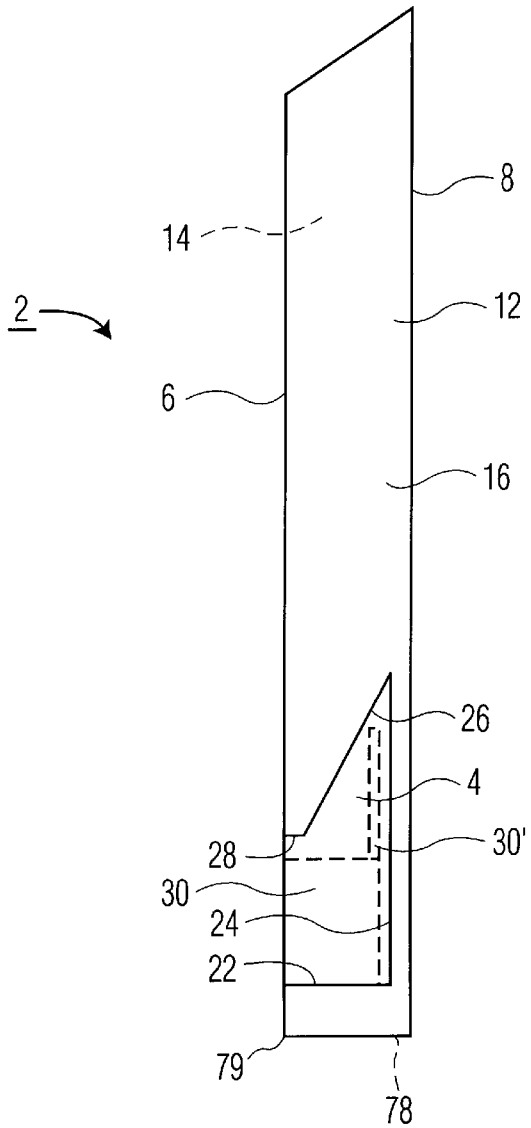
Figure 3:
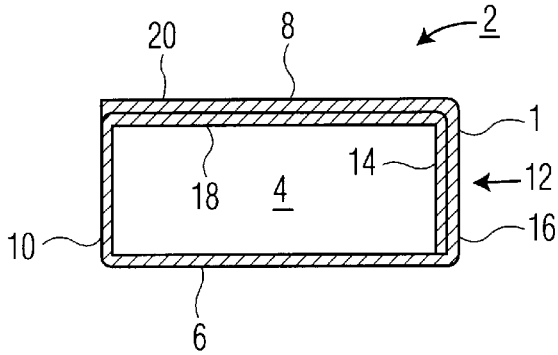
Figure 4:
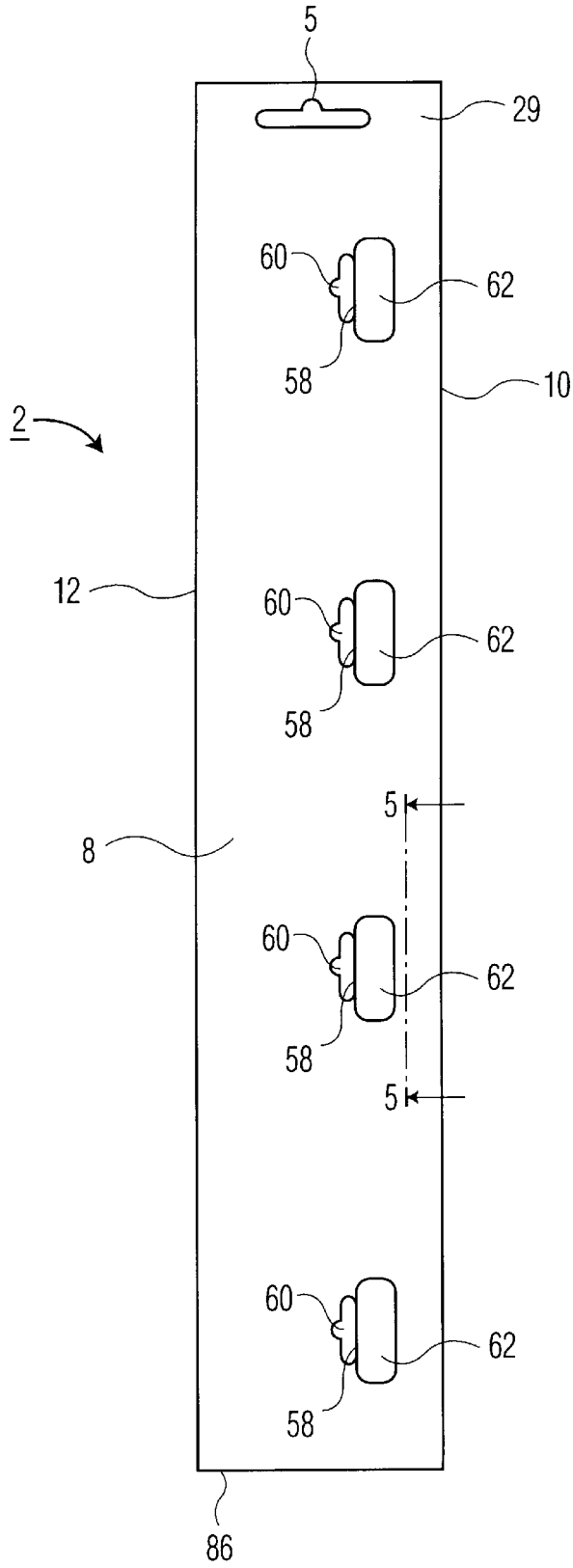
Figure 4A:
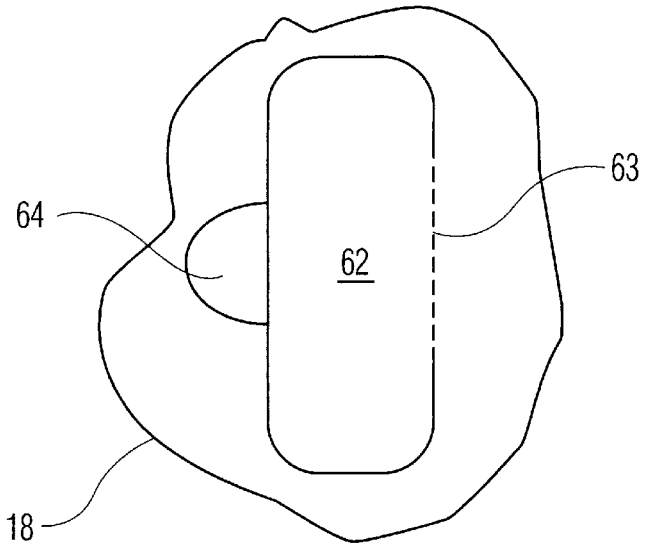
Figure 5:
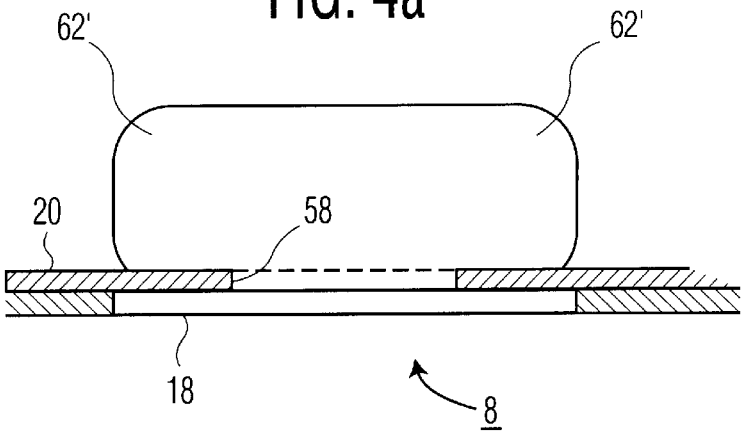
Figure 6:
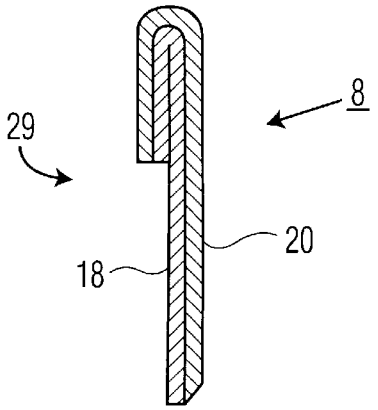
Figure 7:
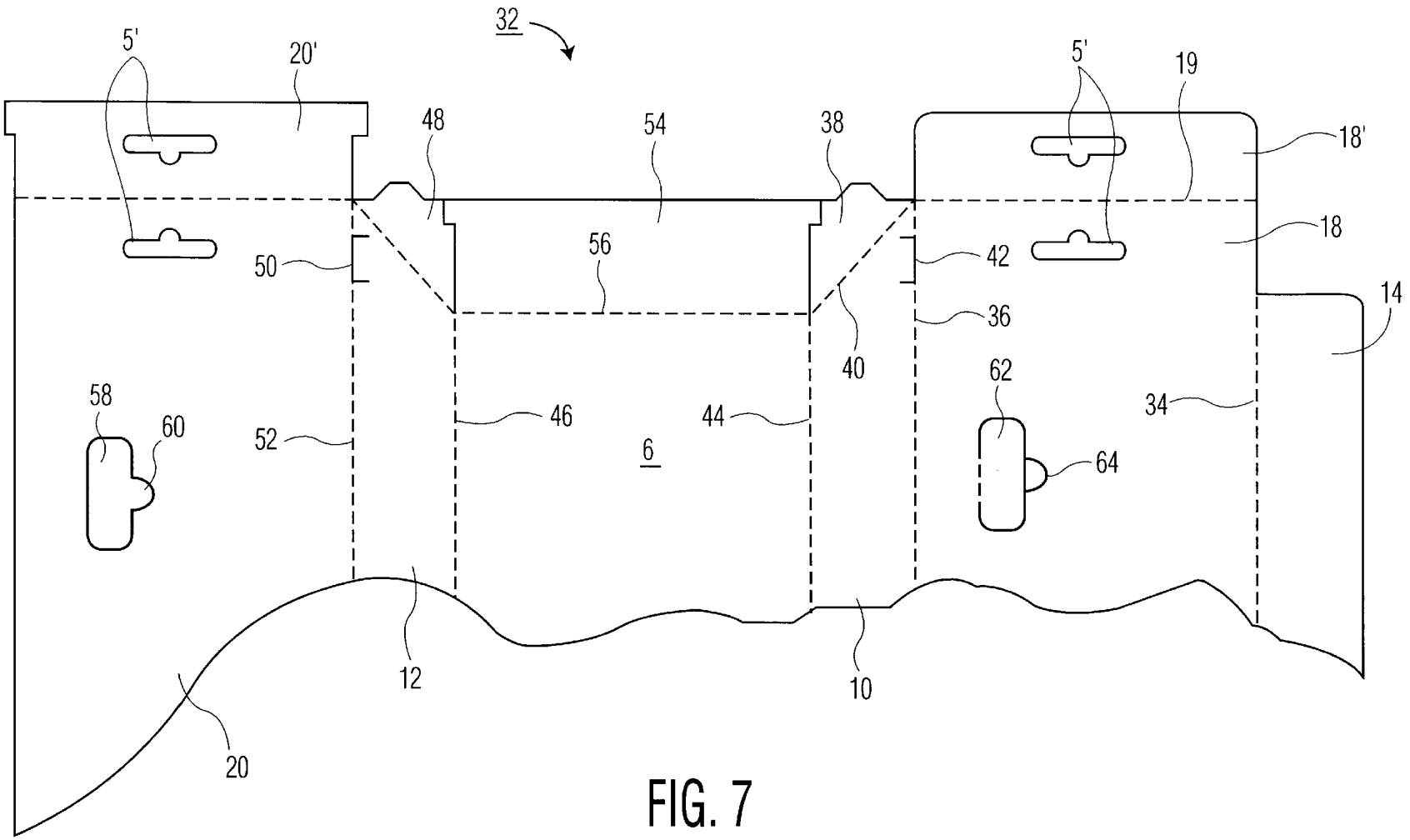
Figure 8:
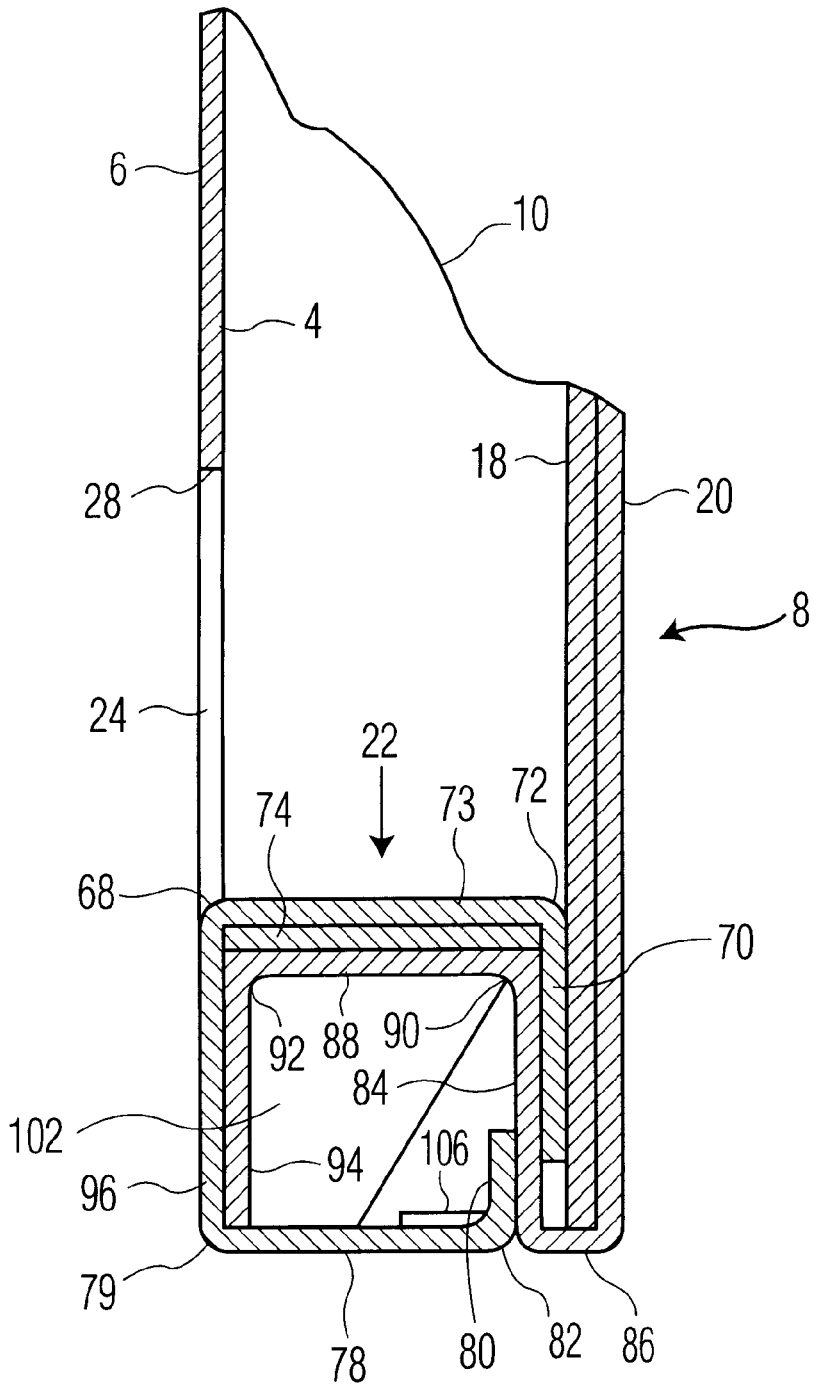
Figure 9:
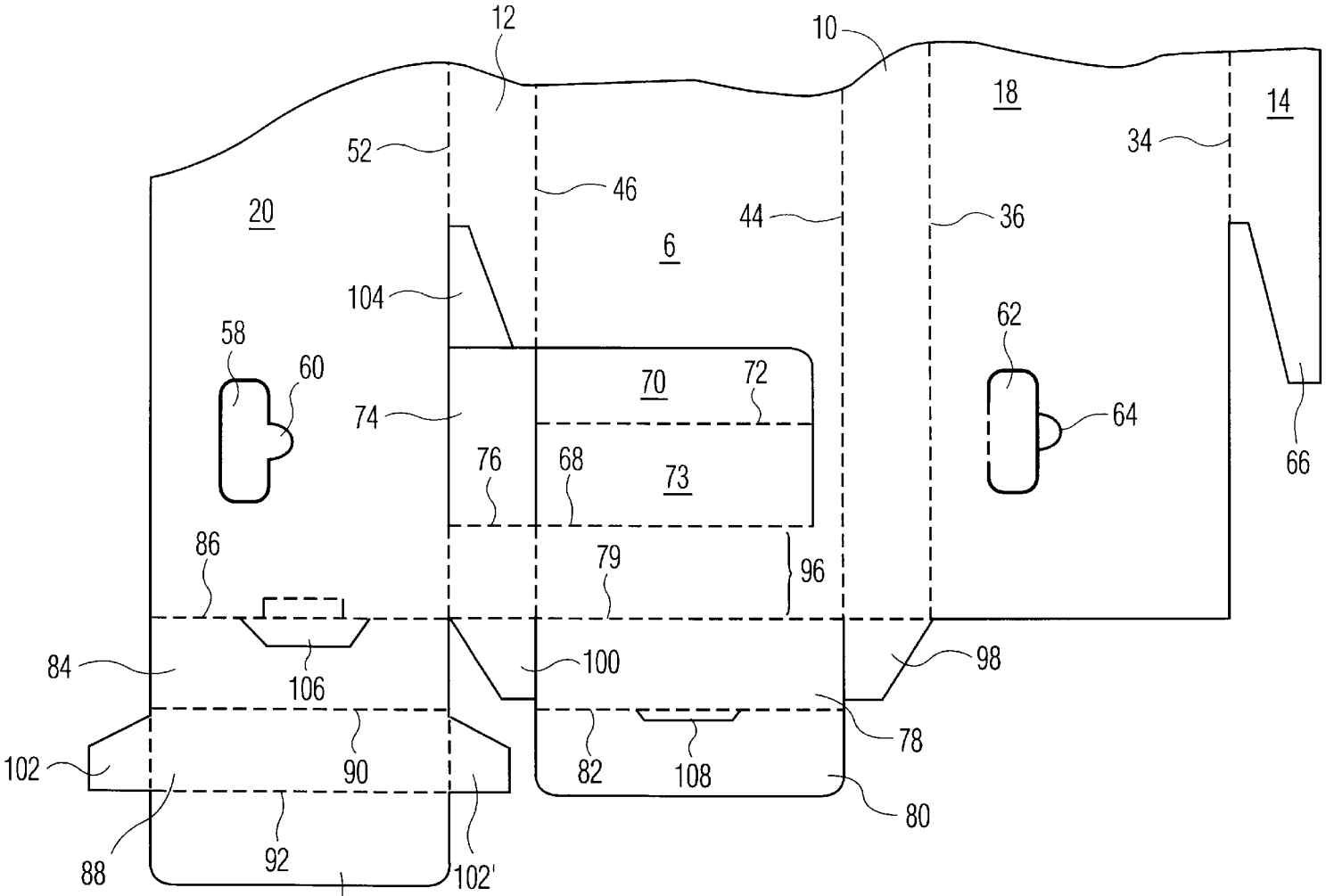

FIG. 2*a* is a side elevation view of the display of FIG. 2 shown not to scale;

FIG. 3 is a plan sectional view of the display of FIG. 2 taken along lines 3—3 of FIG. 2;

FIG. 4 is a rear elevation view of the display of FIG. 1;

FIG. 4*a* is a plan view of a representative interlocking tab for locking the display panels together forming the display of FIG. 1;

FIG. 5 is a sectional elevation view of the rear wall taken along lines 5—5 of FIG. 4;

FIG. 6 is a fragmented side elevation sectional view of the upper portion of the rear. wall of the display of FIG. 2 taken along lies 6—6;

FIG. 7 is a plan view of the top portion of a blank used to make the display of FIG. 1;

FIG. 8 is a sectional side e on view of the display of FIG. 1 taken along lines 8—8; and FIG. 9 is a plan view of the bottom portion of a blank used to make the display of FIG. 1.

In FIGS. 1–4, feed tube display 2 comprises an elongate tube fabricated of one piece compressed paperboard sheet with a rectangular in section interior chapel 4. In the alternative, the sheet material may be corrugated or any other sheet material. The display 2 is normally used with the channel 4 vertical. The display can be hung from a peg display via peg opening 5 in the rear wall 8. The display has a front wall 6, a rear wall 8 and two opposing side walls 10, 12. Side wall 2, FIG. 3, comprises an inner flap 14 and an outer panel 16. Rear wall 8 comprises an inner panel 18 and an outer panel 20, FIG. 3. The inner and outer panels 18 and 20 are folded over each other, FIG. 6, at the top portion 29 of the display. Opening 5 is in this top portion 29. The channel 4 is open at the top and terminates at its bottom at shelf 22. In the figures, the drawing is exaggerated for purposes of illustration and is not to scale.

Front wall 6 and side wall 12 have a product display and removal opening 24. Opening 24 has a triangular portion 26, (FIG. 2*a*), in the side wall 12 which extends upwardly from the front rectangular opening 24 portion 28. The product 30, shown in phantom in FIG. 2*a*, may be conventional disposable rectangular in section camera boxes with a rear upward extending card 30', for example. The triangular opening portion 26 provides access to remove the rear display card portion 30' of the product 30.

In FIG. 7, the blank 32 top portion of the display 2 comprises flap 14 attached to rear inner panel 18 by foldline 34. Foldlines in this figure are shown by dashed lines and through cuts are shown by solid lines. A flap 18' is attached by a foldline 19 to panel 18 to form an inner wall member of the top portion 29, FIG. 1. Side wall 12 is attached to rear panel 18 by foldline 36. A tab 38 folds at foldline 40 and attaches to slot 42 at foldline 36.

Front wall 6 is attached to wall 12 at foldline 44 and to side wall 10 by foldline 46. A tab 48, which is a iron image of tab 38 attaches to slot 50 at foldline 52. These tabs, which are imprinted with a desired finish as is the exterior of all of the walls and flaps, provide a finished look to the interior of side walls at the top portion 29 of the channel 4. Wall 10 is attached to wall panel 20 at foldline 52. Flap 20' folds over and overlies wall 20 and flap 18' folds over and overlies wall 18 at the top of the display to form a finished interior to the channel 4 at the top portion 29 with the tabs 38 and 48. Opening 5 is formed by overlying openings 5' in the flaps 18' and 20' and in the top of the panels 18 and 20. A flap 54 folds at foldline 56 into the interior channel 4 over the front wall 6 at the top of the channel as do the flaps 18' and 20'.

A linear series of four generally equally spaced rectangular openings 58, FIGS. 4 and 7, are in the panel 20 along the panel length dimension. An arcuate finger access opening 60 is at each of the openings 58. A series of rectangular tabs 62 are formed in the inner panel 18, FIG. 7 and respectively correspond to the openings 58. The tabs 62 have body portions that are longer than the corresponding openings 58 in the length direction of the panels, FIG. 4. The tabs 62 are passed through the openings 58 to lock the outer panel 20 to the inner panel 18. The tabs 62 are attached to the inner panel 18 by a fold line 63. The fold line 63 has a length smaller than the length of the openings 58 and body portion of the tabs 62.

The tabs 62 have adjacent finger access openings 64 aligned with openings 60 so that a person's finger may be inserted into the openings 60, 64 and grasp the tab 62, pulling the tab 62 through the opening 58 in the outer panel 20. This is shown in FIG. 5. The tabs 62 and openings 58 and openings 60, 64 thus respectively align when the panels 18 and 20 are juxtaposed, FIG. 4. Each of the tabs 62 is pulled through its corresponding aligned opening 58 in the outer panel 20 locking the inner panel 18 to the outer panel 20 and thus the tube display 2 in its assembled operative condition, FIG. 1. The tabs 62 have wing portions 62', FIG. 5, at each end Rich extend beyond the opening 58 to abut the underlying wall panel 20 releasably locking the inner panel to the outer panel.

In FIG. 9, the bottom of the display 2 at the discharge opening 24 includes a trapezoidal section 66 forming the outer portion of opening 26, FIG. 2*a*. Shelf 22 panel 73 is hinged to panel 6 at foldline 68 and to flap 70 at foldline 72. A flap 74 is hinged at foldline 76 to side wall 10. The flap 74 lies beneath the shelf panel 73 to form the shelf 22, FIGS. 1 and 8. A bottom wall 78, FIGS. 8 and 9, is at the bottom end of the display spaced beneath the shelf 22. Bottom wall 78 is attached to wall 6 panel section 96 by foldline 79 and to flap 80 by foldline 82.

Panel 84, FIGS. 8 and 9, folds at foldline 86 (exaggerated in FIG. 8) juxtaposed with wall panels 18 and 20 and flap 70. In practice, the panels are much thinner relative to each other than that shown in FIG. 8. Flap 70 is sandwiched between panel 84 and panel 18. Panel 88 folds at foldline 90 (FIG. 9) beneath the panel 73 to form shelf 22. Flap 74 is hinged at hinge 76 to wall 10 and is sandwiched between panels 73 and 88. Panel 88 is hinged to flap 94 at foldline 92. Flap 94 lies interior to and overlies wall 6 interior portion 96. Flap 14 overlies and is interior to wall 12 forming a double wall thickness (not shown in FIG. 8). Panels 84 and 88 and flap 94 form a U-shape structure, FIG. 8.

Shelf 22 thus comprises overlying panels 73, 74 and 88. Flaps 98, 100, and 102 (FIG. 9) fold over at their respective foldlines. Flaps 98 and 100 overlie bottom wall 78. Flaps 102, 102' are hinged to panel 88 and depend downwardly overlying respective walls 10 and 12 (as shown in FIG. 8 for flap 102). Flap 74, when folded over at hinge foldline 76, and trapezoidal opening 104 in wall 12 form opening 26, FIG. 2*a*. Tab 106 mates in slot 108 at hinge 82 in bottom wall 78 and in flap 80 to lock the bottom elements of FIG. 9 together in the tube configuration. These overlying members also reinforce the bottom region of the tube structure as shown in FIG. 8.

The panels are imprinted with display indicia for a given product. The product is automatically displayed at the bottom opening at the shelf 22 and is easily removed from the channel 4 at this bottom opening. The interior of the channel at the top of the channel is finished with the overlying interior flaps which also have a finished appearence in common with the exterior surfaces of the tube.

It will occur to one of ordinary skill that various modifications may be made to the disclosed embodiments which are given by way of illistration and not limitation. The scope of the invention is as defined in the appended claims.

What is claimed is:

1. A one piece paperboard display for feeding articles to be dispensed by gravity comprising:

an elongated front wall;

first and second opposing side walls, the first side wall being hinged to the front wall at a first foldline and the second side wall being hinged to the front wall at a second foldline distal the first foldline;

a rear wall formed by a first panel hinged to the fist side wall and a second panel hinged to the second side wall, the first and second panels being juxtaposed with the first panel being exterior and second panel being interior, the second panel, front and side walls forming an article storage and dispensing chamber, the first exterior panel having at least one locking aperture, the walls having top and bottom ends;

a shelf secured to one of the walls adjacent to the bottom end of the walls and forming a bottom wall of the chamber for supporting articles in the chamber when vertical; and at least one locking tab extending from the second interior panel aligned with the at least one locking opening on the first panel and arranged for releasable locking engagement with the at least one locking opening to releasably secure the juxtaposed panels together to form a collapsible tube.

2. The display of claim 1 wherein the front wall and one side wall have a contiguous article dispensing opening adjacent to the shelf for selective manual removal of articles from said chamber.

3. The display of claim 1 including a plurality of said locking openings and a plurality of locking tabs, each tab corresponding to a different locking opening.

4. The display of claim 1 wherein each said front wall, side walls and rear panels include a top portion at the top end which folds over into the chamber to provide a finished appearance to the clamber at the top, the side walls and rear wall terminating at the top end further from the bottom end than the front wall.

5. The display of claim 1 wherein the at least one locking opening includes a finger recess for gripping the at least one locking tab and for displacing the at least one locking tab through the locking opening.

6. The display of claim 1 wherein the at least one locking opening has a length, the at least one locking tab having a body portion with a length parallel to the locking opening and having a length greater than the at least one locking opening length.

7. The display of claim 6 wherein the locking tab is connected to the second inner panel by a fold line, the fold line having a length parallel to the at least one locking tab body portion length and a length magnitude smaller than that of the tab body portion length magnitude forming wing portions on the tab.

8. The display of claim 7 wherein the fold line length is no greater than the length of the at least one locking opening and the wing portions overlie the outer panel.

9. The display of claim 2 wherein the one side wall with the dispensing opening has a first flap lying beneath the shelf, the shelf including a second flap juxtaposed with the rear wall, the shelf being hinged to the front wall, further including a first further wall hinged to the rear outer panel at the bottom end and juxtaposed with the rear outer panel, a second further wall hinged to the first further wall and jutposed with said shelf and first flap, and a third flap hinged to the second further wall and juxtaposed with the front wall between the front wall article dispensing opening and the bottom wall.

10. The display of claim 9 further including a bottom wall hinged to the front wall at the bottom end and a flap hinged to the bottom wall distal the front wall for overlying the rear wall, a second locking tab being secured to the rear outer panel and a slot in the junction between the bottom wall and bottom wall flap for receiving the second locking tab.

11. A one piece paperboard display for feeding articles to be dispensed by gravity comprising:

a paperboard tube having a rectangular chamber for storing and feeding articles;

the tube having an elongated front wall, first and second opposing side walls, the first side wall being hinged to the front wall at a first foldline and the second side wall being hinged to the front wall at a second foldline distal the first foldline, and a rear wall formed by a first panel hinged to the first side wall and a second panel hinged to the second side wall, the first and second panels being juxtaposed with the fist panel being exterior and second panel being interior;

a shelf secured to one of the walls adjacent to the bottom end of the walls and forming a bottom wall of the chamber for supporting articles in the chamber when vertical; and locking tab means coupled to the first and second panels to releasably secure the juxtaposed panels together to form a collapsible tube.

12. The display of claim 11 wherein the locking tab means comprises a tab on the inner panel and a tab locking opening in the outer panel for receiving and releasably securing the tab to the outer panel.

13. The display of claim 12 including a plurality of said tabs and locking openings.

* * * * *